US006217373B1

(12) United States Patent
Johnston

(10) Patent No.: US 6,217,373 B1
(45) Date of Patent: Apr. 17, 2001

(54) THIN-FILM ELECTRICAL TERMINATION AND METHOD FOR MAKING

(75) Inventor: James J. Johnston, St. Petersburg, FL (US)

(73) Assignee: The Wiremold Company, West Hartford, CT (US)

( * ) Notice: Subject to any disclaimer, the term of this patent is extended or adjusted under 35 U.S.C. 154(b) by 0 days.

(21) Appl. No.: 09/253,148

(22) Filed: Feb. 19, 1999

(51) Int. Cl.[7] ..... H01R 12/24
(52) U.S. Cl. ..... 439/499; 439/874
(58) Field of Search ..... 439/492, 499, 439/874, 495; 174/117 F, 117 FF, 72 TR, 250, 91–93, 84 R, 88 R

(56) References Cited

U.S. PATENT DOCUMENTS 5,134,249 * 7/1992 Adachi ..... 174/84 R X
5,780,774 * 7/1998 Ichikawa et al. ..... 174/88 R
5,857,259 * 1/1999 Johnston ..... 439/492 X
5,906,044 * 5/1999 Fujii et al. ..... 174/84 R X
5,962,813 * 10/1999 Shirako et al. ..... 174/88 R
6,135,829 * 10/2000 Johnston ..... 439/874

* cited by examiner

*Primary Examiner*—Brian Sircus
*Assistant Examiner*—Son V. Nguyen
(74) *Attorney, Agent, or Firm*—McCormick, Paulding & Huber

(57) ABSTRACT

A portion of a membrane having electrically conductive ink traces printed on a surface thereof is clamped between two members ultrasonically welded together in assembly by welds which pass through apertures in the membrane at opposite sides of the traces thereon. The assembled members maintain the traces in resilient bearing engagement with exposed electrically conductive portions of electrical conductors contained within slots defined by one of the members. Energy directors integrally formed on the two members are welded together through the apertures while compressive force is applied to the members to clamp the membrane therebetween whereby the traces are electrically terminated by direct resilient bearing engagement with the exposed electrically conductive portions of the conductors.

33 Claims, 5 Drawing Sheets

THIN-FILM ELECTRICAL TERMINATION AND METHOD FOR MAKING

BACKGROUND OF THE INVENTION

This invention relates in general to electrical conductor connections and terminations and deals more particularly with an improved thin-film electrical termination and a method for terminating a thin-film electrical conductor.

In the electronic industry the term thin-film technology relates to several categories of product including, flexprint, membrane switches, touch pads, high density flat cable, sculptured flex circuits and integrated circuit components. Two forms of conductive materials are generally employed in these products, namely etched copper and electrically conductive ink containing a relatively high percentage silver. The etched copper offerings are generally an extension of printed circuit board technology and employ fine line copper traces having a thickness in the range of 0.001–0.002 inches. The silver ink-type products feature circuit paths printed or silk-screened on a substrate and having a thickness generally within the range of 0.0003–0.0007 inches.

The electrical termination of thin-film conductive members offer a wide range of product and process alternatives. The etched copper variety, being the more stable of the two options, is suitable for termination by several standard termination techniques including edge connection for printed circuit boards employing a stiffener or paddle board approach, soldering or welding including laser techniques, contact piercing type crimped terminations, and pressure or spring termination designs.

Where the conductive ink concept is employed methods of termination to other conductive media has been quite limited. Multiple contact pressure schemes have been proposed and employed particularly for direct connection to conventional printed circuit boards to facilitate traditional means of interface activity. A low density (0.050 inch or more contact spacing) MYLAR pierce/crimp terminal has been utilized which enables a pluggable interface to standard cable type conductors (stranded or solid wires). However, direct termination to stranded or solid conductive wires has heretofore not been feasible. This limitation coupled with new high density termination requirements has created a need for an improved means for termination to thin-film conductors of both etched copper and conductive ink-types. The present invention is concerned with the aforesaid problem.

Accordingly, it is the general aim of the present invention to provide an improved thin-film termination and method for terminating thin-film traces, particularly conductive ink traces, directly to conventional solid wire conductors. It is a further aim of the present invention to provide an improved, economical termination and termination method to facilitate low cost, high density termination of electrically conductive thin-film traces.

SUMMARY OF THE INVENTION

In accordance with the present invention a thin-film electrical termination is formed within a terminal assembly which includes a cradle member having a top surface and an energy director cap having a bottom surface disposed in opposing relation to the top surface of the cradle member. The cradle member has a conductor receiving slot which opens upwardly through its top surface. An axially elongated electrical connector received within the slot includes an upwardly exposed axially extending electrical conducting portion. An associated portion of a circuit membrane disposed between the cradle member and the energy director cap has an electrically conductive trace thereon which includes a downwardly facing contact portion engaged with the upwardly exposed axially extending electrical conducting portion of the conductor within the slot. Connecting means extend through apertures formed in the membrane at opposite sides of the trace and integrally join to the top surface of the cradle member to the bottom surface of the energy director cap for maintaining the energy director cap in assembly with the cradle member with a portion of the membrane clamped therebetween and the contact portion of the trace in resilient bearing engagement with the upwardly facing axially extending electrical conducting portion of the electrical conductor, whereby the electrical conductor is maintained in electrically terminating relation to the electrically conductive trace. Energy directors provided on the top surface of the cradle member and on the bottom surface of the energy director cap are welded together within the circuit membrane apertures by the simultaneous application of pressure and high frequency vibratory energy to the cradle member and the energy director cap to form the terminal assembly within which the thin-film termination is formed.

DETAILED DESCRIPTION OF PREFERRED EMBODIMENT AND METHOD

Figure 1:
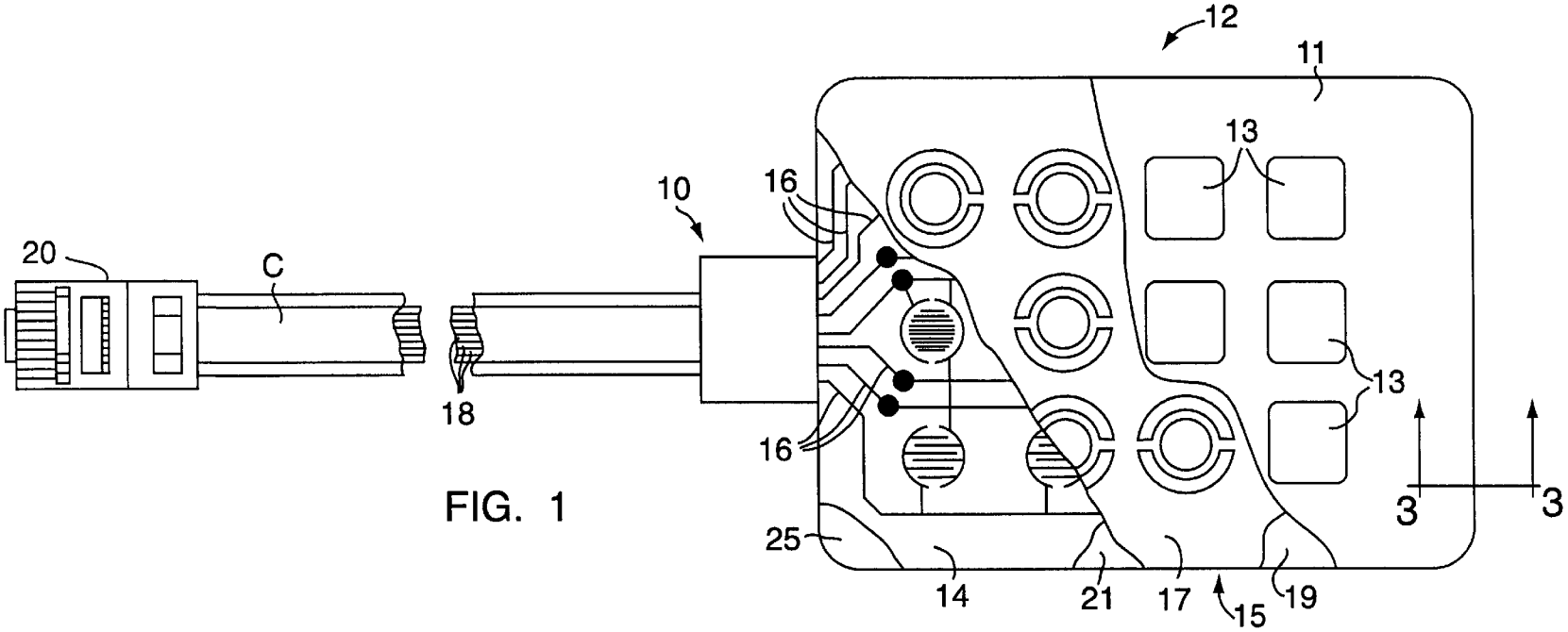
FIG. 1 is a fragmentary top plan view of a terminal assembly embodying the invention and terminating a cable to circuit traces on a keypad.

The present invention may be embodied in a single thin-film electrical termination or in a plurality of such electrical terminations. In the drawings and in the description which follows, the invention is illustrated and described with reference to a typical product which has a high density array of electrical terminations. The product, illustrated in FIGS. 1–3, includes a terminal assembly embodying the invention and indicated generally at 10, shown connected in terminating relation to a keypad of a type well known in the electronics art and designated generally by the numeral 12.

Figure 2:
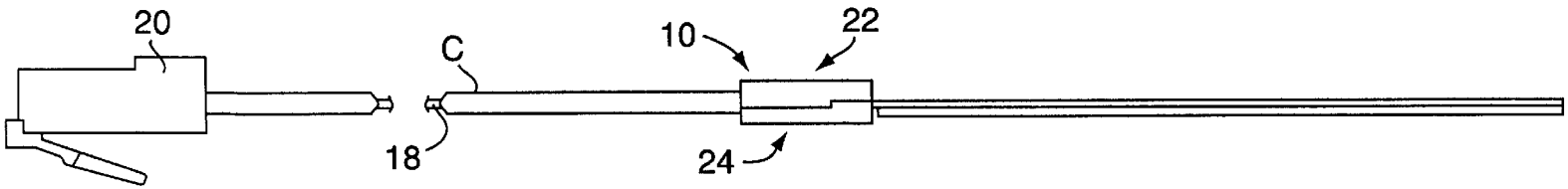
FIG. 2 is a fragmentary side elevational view of the terminal assembly and keypad shown in FIG. 1.

The illustrated keypad 12, which is specifically adapted to control an associated electronic device (not shown), essentially comprises a multi-layer membrane switch and includes a circuit membrane 14, which, as oriented in FIG. 1, has a plurality of electrical conductive ink circuit traces 16, 16 imprinted on its upper surface. In accordance with the present invention, each circuit trace 16 is electrically terminated within the terminal assembly 10 by direct electrical connection to an associated one of the plurality of individually insulated resilient compressible electrical conductors 18, 18 which comprise a flexible shielded flat cable, indicated by the letter C. The illustrated cable C has an RJ45 telecommunications plug connector 20 electrically connected to its free end for plugging engagement with a mating telecommunications jack (not shown) such as a jack on a computer or other electronic device to be controlled by the keypad switch 12.

Figure 3:
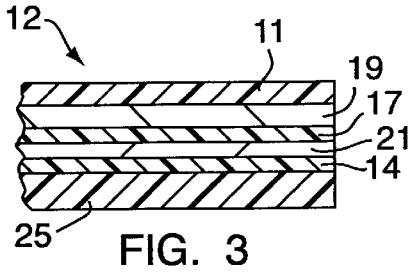
FIG. 3 is a somewhat enlarged fragmentary sectional view taken along the line 3—3 of FIG. 1.

Further referring to FIG. 1, the illustrated keypad 12 essentially comprises a generally rectangular multi-layer structure and includes a graphic layer or faceplate 11, which has a plurality of touch pads 13, 13, and a generally rectangular dome switch assembly, indicated generally at 15, which includes a switch plate 17 sandwiched between apertured spacers 19 and 21 and located below the faceplate 11, as shown in FIGS. 1 and 3. The dome switch assembly 15 has a plurality of switch domes aligned with apertures in the spacers 19 and 21 and with the touch pads 13, 13 and is operated by the touch pads 13, 13. The circuit membrane 14 which carries the circuit traces 16, 16 is positioned immediately below the switch dome assembly 15 to cooperate with the switch domes, in a manner well known in the electrical switch art, and comprises a thin sheet of flexible dielectric material, preferably MYLAR, having a thickness of about 0.005 inches. The circuit membrane 14 has a generally rectangular main body portion which substantially complements the rectangular faceplate 11 and the rectangular dome switch assembly 15. A termination tab, indicated by the letter T, which comprises a part of the circuit membrane 14 is integrally connected to the main body portion of the membrane 14 and extends outwardly from an associated edge of the main body portion of the membrane and beyond the rear edge of the faceplate 11. Adhesive layers (not shown) maintain the various keypad components in assembly with each other.

The illustrated keypad 12 further includes a rectangular stiffener indicated by the numeral 25. The presently preferred stiffener 25 is formed from a sheet of LEXAN complements the other rectangular layers which comprise the keyboard 12 and which also include the faceplate 11, the dome switch assembly 15, the circuit membrane 14 and the spacers 19 and 21. The stiffener 25 preferably comprises an outer layer of the keypad 12 and has a support tab 27 integrally formed on it which projects outwardly from it in underlying relation to an associated portion of the termination tab T. The termination tab T extends outwardly for some distance beyond the outer edge of the support tab 27 as shown in FIG. 4 and for a purpose which will be hereinafter evident.

Figure 4:
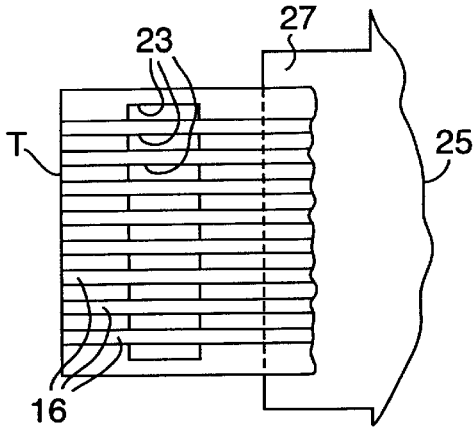
FIG. 4 is a fragmentary plan view showing a portion of the circuit membrane termination tab and the stiffener support tab of the keypad shown in FIGS. 1 and 2.
Figure 5:
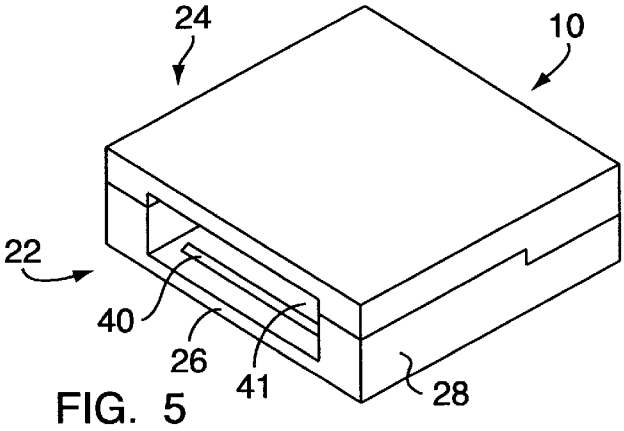
FIG. 5 is a perspective view of the terminal assembly shown in FIG. 1.
Figure 6:
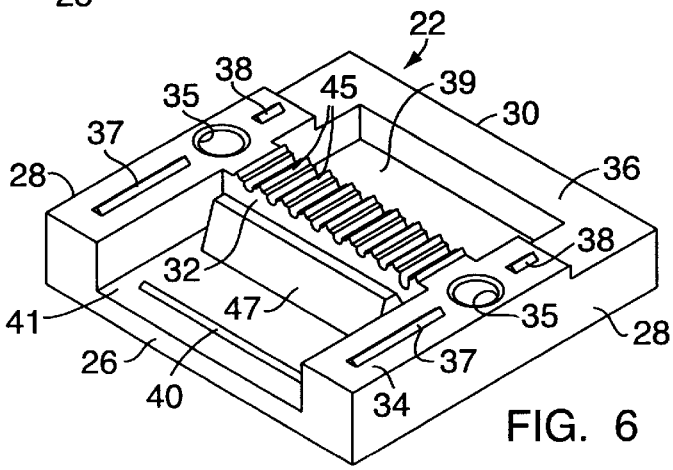
FIG. 6 is a perspective view of the cradle member.
Figure 7:
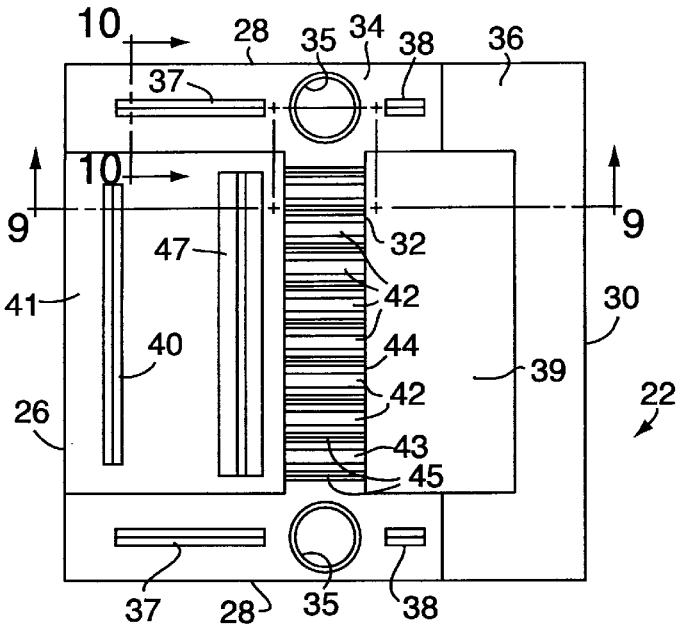
FIG. 7 is a somewhat enlarged top plan view of the cradle member.

The traces on the circuit membrane 14 may, for example, be defined by etched copper or other electrically conductive material, however, the presently preferred thin-film circuit traces 16, 16 are formed by an electrically conductive ink compound containing approximately 80 percent silver and which is applied to the upper surface of the circuit membrane 14, as it appears oriented in FIGS. 1 and 4. The conductive ink traces 16, 16 may be printed on the circuit membrane 14 or may be applied to it by a silk-screening process or any other appropriate application means. In the illustrated embodiment the traces define switching circuits on the main body portion of the circuit membrane 14 and extend from the main body portion outwardly across the termination tab T in closely spaced parallel relation to each other. Each trace 16 has a width of 0.002 inches. The parallel traces 16, 16 on the tab T are spaced on 0.004 inches centers, as shown in FIG. 4.

Further referring to FIG. 4, an in-line series of rectangular apertures 23, 23 arranged in alternate series with the traces 16, 16 and in parallel relation to each other, die-cut or otherwise formed in the extending end portion of the termination tab T, that is the portion of the tab T which extends beyond the support tab 27. The apertures 23, 23 extend through the tab T and open through the upper surface of the tab T between each pair of adjacent traces 16, 16 and immediately adjacent the outermost traces at the opposite ends of the series. The width of each rectangular aperture 23 is at least equal to the spacing between a pair of adjacent apertures, as shown in FIG. 4. The traces 16, 16 substantially cover the spaces between adjacent apertures 23, 23. Since the keypad 12 has eight circuit traces 16, 16 to be terminated, nine rectangular apertures 23, 23 are formed in the termination tab T. Thus, each trace 16 is disposed between and immediately bordered by an associated pair of parallel rectilinear apertures 23, 23 in a region of termination defined by the outwardly extending portion of the termination tab T.

Before further considering a thin-film electrical termination and the method by which such a termination is made, the terminal assembly 10, which comprises a part of each termination and within which each termination is formed will be considered in some detail. Specifically, the terminal assembly 10 is made by ultrasonically joining or welding together two unitary terminal sections which include a cradle member, indicated generally at 22, and an energy distribution cap, designated generally by the numeral 24.

Figure 10:
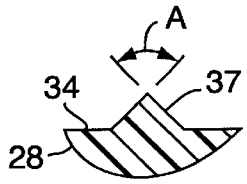
FIG. 10 is a somewhat enlarged fragmentary sectional view taken along the line 10—10 of FIG. 7.

Referring now to FIGS. 5–9, and considering first the cradle member, the illustrated cradle member 22 is molded from an ultrasonically weldable dielectric thermoplastic material, preferably LEXAN, the same material from which the keypad stiffener 25 is made. The cradle member 22 has a generally rectangular bottom wall 26 and a pair of opposing side walls 28, 28, which project upwardly from the bottom wall. A front wall 30 projects upwardly from the forward marginal edge portion of the bottom wall 26 and extends transversely of the bottom wall between the sidewalls 28, 28. A cradle wall 32 projects upwardly from the bottom wall 26 and extends across a central portion of the cradle member 32 between the sidewalls 28, 28 in rearwardly spaced relation to the front wall 30, substantially as shown. The sidewalls 28, 28 and the cradle wall 22 cooperate to define an upwardly facing top surface 34. The front wall 30 and forward end portions of the sidewalls 28, 28 form an upwardly facing upper surface 36 generally parallel to but somewhat below the plane of the top surface 34. A pair of generally cylindrical blind guide bores 35, 35 formed in the sidewalls 28, 28 open upwardly through the top surface 34 transversely at opposite ends of the cradle wall 32, substantially as shown. Energy directors 37, 37 and 38, 38 project upwardly from the top surface 34 and extend along the sidewalls 28, 28. Each of the energy directors 37, 37 and 38, 38 has an apex angle of approximately 90°, as best shown in FIG. 10, where the apex angle is indicated by the letter A. The cradle member 22 defines an upwardly open cavity 39 forward of the cradle wall 32 and an upwardly and rearwardly open recess 41, rearward of the cradle wall, best shown in FIG. 6 for receiving a portion of the cable C. A cable retaining energy director 40 projects upwardly from the bottom wall 26 within the recess 41 and extends generally transversely of the recess near the rear end of the recess, substantially as shown. An integral conductor stabilizing pedestal 47 projects upwardly from the bottom wall 26 within the recess 41 and extends transversely of the recess in close proximity to and in parallel alignment with the cradle wall 32, substantially as shown in FIGS. 6–9.

Figure 11:
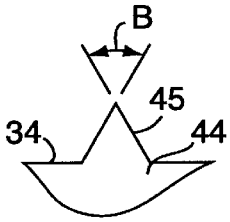
FIG. 11 is a somewhat enlarged fragmentary end elevational view showing a secondary energy director.
Figure 8:
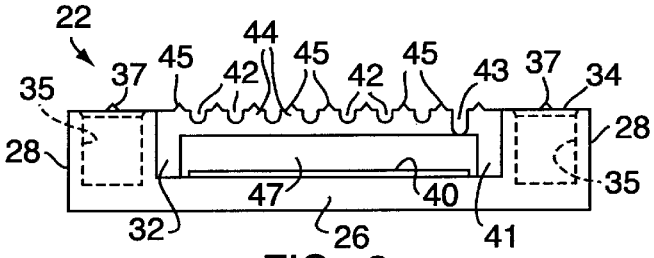
FIG. 8 is a rear end elevational view of the cradle member.
Figure 9:
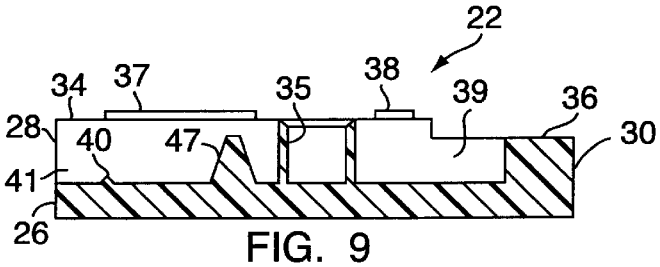
FIG. 9 is a sectional view taken generally along the line 9—9 of FIG. 7.

A transversely extending in-line array or series of parallel conductor receiving slots 42, 42 and 43 separated from each other by parallel barriers 44, 44 are formed in the cradle wall 32, extend from front to rear across the cradle wall 32 and open upwardly through the top surface 34, substantially as shown for receiving the individual conductors 18, 18 which comprise the cable C. A secondary energy director 45 projects upwardly from a portion of the top surface 34 of each barrier 44 and extends centrally along the barrier in a direction generally parallel to the direction of slot extent. Secondary energy directors 45, 45 are also located on the top surface 34 transversely outboard of the endmost slots 42 and 43 in the series. Each secondary energy director 45 has an apex angle of 60 degrees as shown in FIG. 11, where the apex angle is indicated by the letter B. The number of conductor receiving slots 42, 42 and 43 provided may vary and will be determined by the number of individual electrical connections or thin-film terminations to be formed within the terminal assembly 10. The illustrated terminal assembly 10 is adapted to accommodate eight thin-film terminations, therefore eight conductor receiving slots are formed in the cradle wall 32 and nine secondary energy directors 45, 45 are provided, one more than the number of slots, so that each of the slots 42, 42 and 43 is generally bordered by or disposed between a pair of secondary energy directors 45, 45. It should be noted that seven of the eight illustrated conductor receiving slots are substantially identical and are identified by the numerals 42, 42, whereas, the eighth slot, identified by the numeral 43, which occupies the number one pin position at one end of the in-line series, has a slot depth greater than the slot depth of the other seven slots, for a purpose which will be hereinafter discussed.

Figure 12:
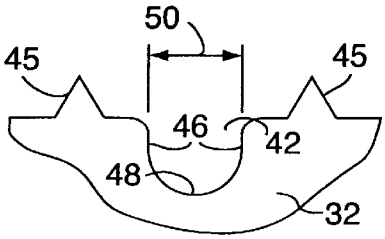
FIG. 12 is a somewhat enlarged fragmentary elevational view showing a portion of the cradle wall including a typical conductor receiving slot.

A typical conductor receiving slot 42, shown in FIG. 12, has opposing parallel sidewalls 46, 46 and a bottom or inner end wall 48 shaped to substantially complement an associated portion of an electrical conductor 18 to be received therein. The width dimension of the slot 42, indicated by the numeral 50 in FIG. 12, is substantially equal to the nominal width dimension of an associated electrical conductor 18 to be received therein.

The depth of each slot 42 is predetermined to satisfy the physical characteristics and dimensions of portion of a single conductor or a plurality of conductors to be received within the slot. Thus, for example, where a conductor 18 to be connected to an associated trace 16 comprises a resilient axially elongated stranded soft copper wire conductor, such as a 28AWG seven strand conductor, which will undergo significant physical and more specifically cross-section dimensional change when subjected to a radially directed compressive force of a predetermined magnitude, as contemplated by the assembly method of the present invention, this factor must be considered in determining required slot depth, as will be hereinafter further discussed. The change in cross-sectional dimension resulting from the application of a radially directed force of known magnitude to an axially elongated portion of a compressible conductor during assembly of the terminal assembly 10, and hereinafter referred to as the compressibility factor, is determined for at least one of the conductors 18, 18 to be connected to the traces 16, 16 and is employed in determining the optimum depth dimension of the slots 42, 42 which receive the conductors 18, 18 therein, as will be hereinafter discussed.

Figure 13:
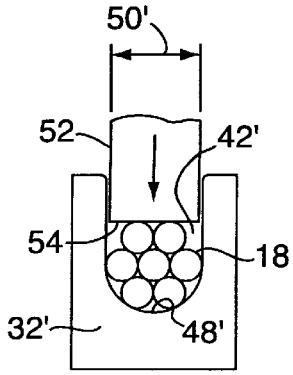
FIG. 13 is a somewhat schematic view of a testing apparatus for determining the compressibility factor of an electrical conductor.

The compressibility factor for a conductor may, for example, be determined by providing a sample testing device, indicated generally at 32' in FIG. 13, made from the material from which the cradle member 22 is made, having a test slot 42' corresponding generally to the slot 42 shown in FIG. 12, a width dimension 50' substantially corresponding to the nominal cross-sectional dimension of a stranded wire conductor 18, and a bottom or inner end wall 48' which complements an associated lower portion of a conductor 18, substantially as shown. A downwardly directed force of known magnitude to be applied by an ultrasonic welding machine in assembling the electrical terminal assembly 10 is applied to a bare axially extending portion of the conductor by a ram 52 slideably received within the slot 42'. The ram 52 has a downwardly facing bearing surface 54 at its lower end for engaging an upwardly exposed portion of the conductor 18 within the slot 42'. The resulting compressibility factor, which may be expressed as a percentage change in the nominal cross-sectional dimension of a stranded wire conductor 18, measured in the direction of applied force and in response to the force of known magnitude, may then be utilized to determine the depth dimension of the slot 42 required in practicing the invention. A further discussion of the compressible factor and the manner in which it is determined and employed in an ultrasonic welding process for terminating electrical conductors to form electrical connections is found in my copending U.S. patent application Ser. No. 08/393,843d, entitled METHOD FOR MAKING ELECTRICAL CONNECTION, filed Feb. 24, 1995, assigned to the assignee of the present invention, and hereby adopted by reference as part of the present disclosure.

It should now be apparent that when the invention is practiced with compressible conductors of other kinds, as, for example, solid wire conductors or solid electrical terminals used to terminate thin-film conductors or traces, the compressibility factor will be a consideration in the design of a proper cradle member for use in practicing the invention and may be determined using a test sample conductor or terminal disposed within a test slot, generally as aforedescribed.

The energy director cap 24, best shown in FIGS. 14–17 is adapted for mating engagement with the cradle member 22 and also comprises a generally rectangular member molded or otherwise formed preferably from the same ultrasonically weldable dielectric thermoplastic material from which the cradle member 22 is made. The energy director cap 24, which is shown in an inverted position in FIGS. 14 and 15, has an upper wall 56 and a pair of opposing sidewalls 58, 58 having bottom surfaces 60, 60. The forward end portion of the side walls 58, 58 are stepped downwardly for complementary mating engagement with the forward ends of the cradle member side walls 28, 28. A pair of cylindrical dowel pins 62, 62 sized to be received within and complement the cylindrical guide bores 35, 35 in the cradle member project downwardly from the sidewall bottom surfaces 60, 60. The dowel pins 62, 62 cooperate with the guide bores 35, 35 to assure proper alignment of the cradle member 22 and the energy director cap 24 during assembly.

Figure 14:
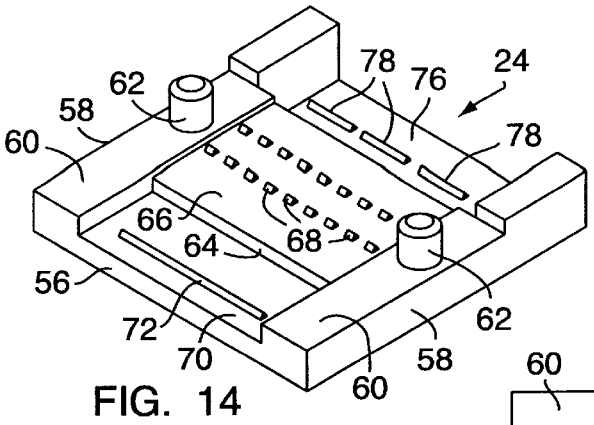
FIG. 14 is a perspective view of the energy director cap shown in an inverted position.

A bearing wall 64 extends transversely between the sidewalls 58, 58 has a downwardly facing bottom surface 66 upwardly spaced from the lower surfaces 60, 60 a distance substantially equal to the thickness of the circuit membrane 14 as best seen in FIG. 14. A plurality of pairs of longitudinally and transversely spaced apart primary energy directors 68, 68, equal in number to the number of rectangular apertures 23, 23 in the termination tab T, project downwardly from the bottom surface 66. Each pair of primary energy directors 68, 68 is aligned with an associated aperture 23 when the energy director cap 24 is assembled with the cradle member 22. The energy director cap 24 has a downwardly and rearwardly open recess 70, substantially as shown, for cooperating with the recess 41 in the cradle member 22 to receive an end portion of the cable C. An energy director 72 projects downwardly from the upper wall 56 within the recess 70 and extends transversely along the upper wall 56. Like the energy director 40 on the cradle member, the energy director 72 on the cap has an apex angle of approximately 90°. The energy director 72 is disposed immediately above and in parallel alignment with the energy director 40 when the energy director cap 24 is assembled with the cradle member 22.

Figure 15:
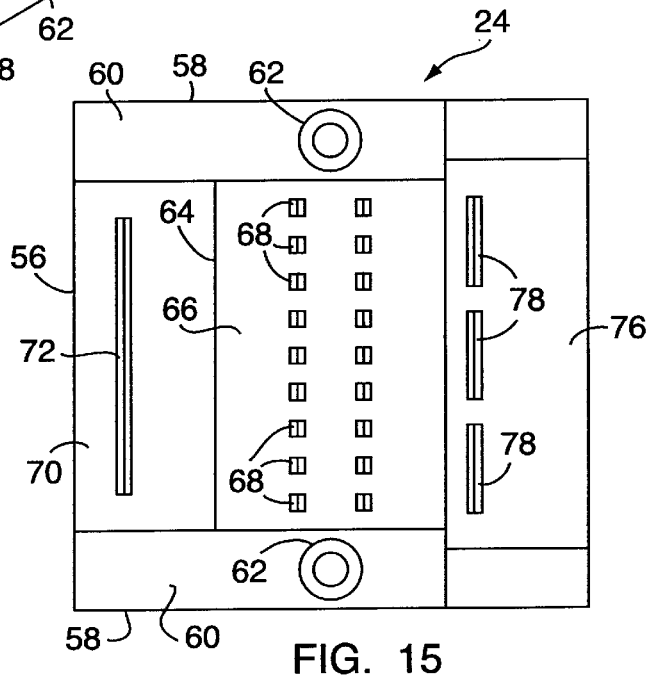
FIG. 15 is a somewhat enlarged bottom plan view of the energy director cap of FIG. 14.
Figure 16:
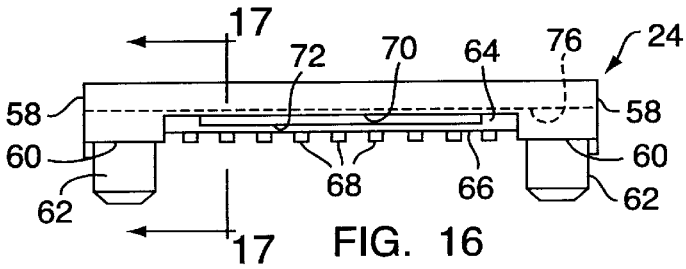
FIG. 16 is a rear elevational view of the energy director cap.

The energy director cap 24 also defines a forwardly and downwardly open recess 76 for receiving and containing the support tab 27 on the keypad 12 when the terminal assembly 10 is assembled with the keypad. Energy directors 78, 78 depend from the upper wall 56 within the recess 76 and extend transversely of the recess, substantially as shown in FIGS. 14 and 15, for engaging the support tab 27.

Preparatory to forming the terminal assembly 10 and connecting it in terminating assembly to the keypad 12, an end portion of the outer insulation jacket 18 is removed from the flat cable C to expose end portions of the eight (8) individually insulated stranded wire conductors 18, 18 which comprise the cable. Insulation is then stripped from each individual conductor 18, preferably in spaced relation to the exposed free end of the conductor, to provide an exposed axially extending electrically conductive portion of the conductor axially spaced from the free end of the conductor and having an axial length substantially equal to the axial length of a slot 42 or 43 within which the stripped portion of the conductor is to be received. The cradle member 22 is then preferably positioned with the slots 42, 42 opening in an upward direction to receive the various conductors 18, 18. Thereafter, an exposed axially extending bare wire portion of each conductor 18 is positioned within an associated one of the slots 42, 42 and 43, the insulated free ends of the conductors 18 being disposed within the cavity 39.

As previously noted, the slot 43 located at the number 1 pin position at one end of the array of slots has a depth somewhat greater than the depth of the other slots 42, 42 in the cradle member. The illustrated slot 43 is adapted to accommodate two vertically stacked stranded wire conductors. One of the two stacked conductors is an individually insulated stacked conductor 18 from which insulation has been stripped, as herein before described. The other of the conductors is a drain wire, that is a bare or uninsulated wire which is disposed within the outer insulation jacket of the cable C in contacting engagement with metal shielding within the cable insulation jacket. Thus, electrical grounding paths may be established between the cable shielding, the telecommunications plug 20 and one of the electrically conductive traces 16, 16 carried by the circuit membrane termination tab T and connected to a grounding plane (not shown) located within the keypad 12. Where two such wires are to be disposed within a single cradle slot, such as the slot 43, for example, for termination to an associated trace 16 on the termination tab T, a determination of the compressibility factor for the two wires is made to enable determination of the required depth of the slot 43 as herein before discussed.

Figure 18:
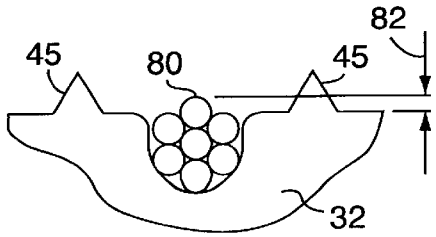
FIG. 18 is a somewhat schematic fragmentary elevational view of the cradle member and illustrates the compression allowance.
Figure 17:
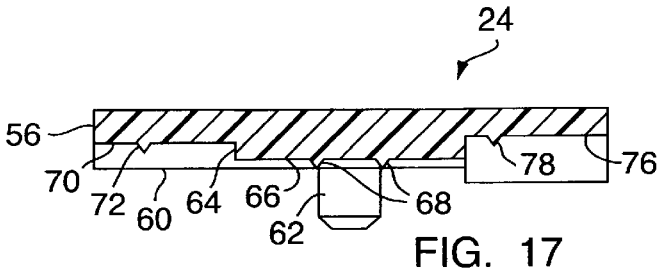
FIG. 17 is a sectional view taken along the line 17—17 of FIG. 16.
Figure 20:
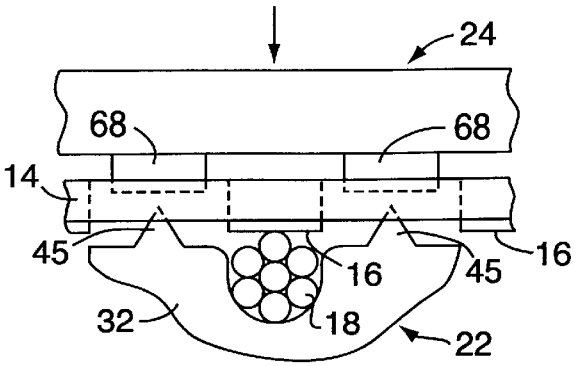
FIG. 20 is a somewhat schematic fragmentary elevational view showing a termination in an initial stage of assembly.
Figure 19:
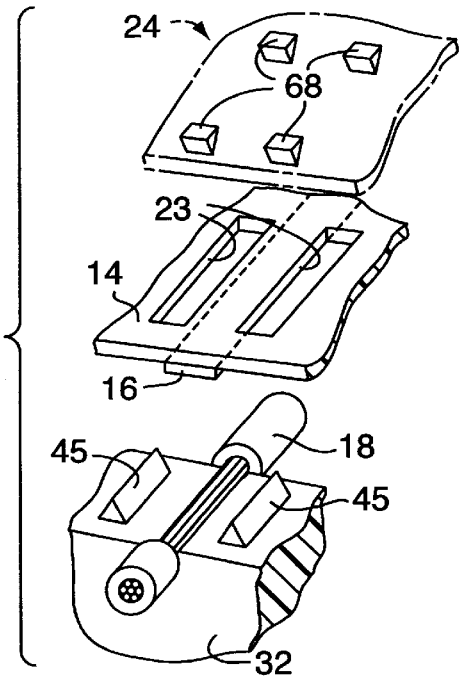
FIG. 19 is an exploded fragmentary perspective view showing a typical thin-film termination in accordance with the present invention before final assembly.

When the various electrical conductors 18, 18 have been properly positioned within the slots 42, 42 and 43, the lower portion of the cable C will be disposed within the cradle member recess 41 with insulated portions of the various conductors 18, 18 resting upon the conductor stabilizing pedestal 47. It should now be noted that each of the conductors 18, 18 includes an upwardly exposed axially extending conducting portion 80 which extends in the direction of slot extent and which is disposed at a level above the level of the cradle member top surface 34 to provide compression allowance, as best shown in FIG. 18 where the compression allowance is indicated by the numeral 82.

After the various electrical conductors 18, 18 have been properly positioned within the slots 42, 42, and 43, the termination tab T on the circuit membrane 14 is positioned on the cradle member 22 with the traces 16, 16 on the termination tab T facing in a downward direction, so that a contacting portion of each trace 16 is disposed in overlying engagement with an upwardly exposed axially extending conducting portion 80 of an associated electrical conductor 18. When the termination tab T has been properly positioned as aforedescribed, each secondary energy director 45 projects upwardly into an associated one of the apertures 23, 23.

The energy director cap 24 is next positioned on the cradle member 22 with the dowel pins 62, 62 engaged within the cylindrical guide bores 35, 35. When the cap is properly positioned the primary energy directors 68, 68 which depend from the energy director cap bottom surface 66 are automatically aligned in registration with the rectangular apertures 23, 23 in the circuit membrane termination tab T. A pair of primary energy directors 68, 68 associated with each aperture 23 is positioned in transverse crossing relation to opposite end portions of a secondary energy director 45 disposed within that aperture. The support tab 27 is located within the recess 76 and engaged by the energy directors 78, 78 on the cap. The cradle member 22 and the energy director cap 24 are now ready for final assembly.

In accordance with the presently preferred method for practicing the invention, the pre-assembled sections of the terminal assembly 10, which include the cradle member 22 and the energy director cap 24, are supported within a suitable fixture mounted on an ultrasonic welding machine (not shown) while compressive force is applied to the supported sections by the horn of the welding machine. When the applied force reaches a predetermined first magnitude the horn of the welding machine applies ultrasonic vibratory energy to the pre-assembled sections 22 and 24 to weld the sections together at the interfaces defined by the coengaging primary and secondary energy directors while the applied force is simultaneously increased until a second predetermined force magnitude is attained. The assembly is then maintained under compression until the welds solidify. More specifically, after the pre-assembled terminal assembly 10 has been positioned in the ultrasonic welding machine, compressive force is applied to the terminal assembly to urge the top and bottom surfaces of the cradle member 22 and the cap 24 toward each other. Ultrasonic vibratory energy and compressive force are then simultaneously applied to the assembly to melt the various energy directors at points of contact therebetween. Thus, the primary energy directors 68, 68 are melted at the points of engagement with the secondary energy directors 45, 45 whereby connecting welds are produced within and near the opposite ends of each of the rectangular apertures 23, 23. It should be noted that the central portion of each secondary energy directors 45, that is, the portion of the secondary energy director 45 which extends between the primary energy directors 68, 68 in each slot 23, does not undergo substantial melting. However, slight melting may occur where the apex of each secondary energy director central portion engages the bottom surface of the energy director cap. The application of high frequency vibratory energy to the assembly melts the energy directors 36 and 38 to further weld the energy director cap to the cradle member. Welding may also occur between the dowel pins 66, 66 and the bores 35, 35 in which these pins are received thereby providing additional integrity to the resulting assembled structure.

The energy directors 40 and 72 at the top and bottom surfaces of the cable receiving recess 70 burn into the outer insulation jacket of the cable C, thereby welding the insulation jacket to the terminal assembly providing strain relief for the cable relative to the terminal assembly 10. The pedestal 47 is welded to the insulation on each of the individually insulated wire conductors 18, 18, during the assembly process and serves to stabilize the latter conductors so that the conductor terminations resist movement in response to lateral movement of the cable C relative to the terminal assembly 10 formed by the cradle member 22 and the energy director cap 24. The ultrasonic welding operation also serves to melt the energy directors 78, 78, thereby welding the terminal assembly to the support tab 27 on the keypad 12.

During the ultrasonic welding process some wiping action occurs between the coengaging surfaces of the contact portion of each trace 16 and the axially extending conduction portion of each associated electrical conductor 18, that is the portion of each conductor which is disposed within each slot 42 and in engagement with an associated trace 16 within the slot. This wiping action assures production of a substantially gas-tight termination or connection between the coengaging portions of each electrical conductor 18 and its associated trace 16.

Figure 21:
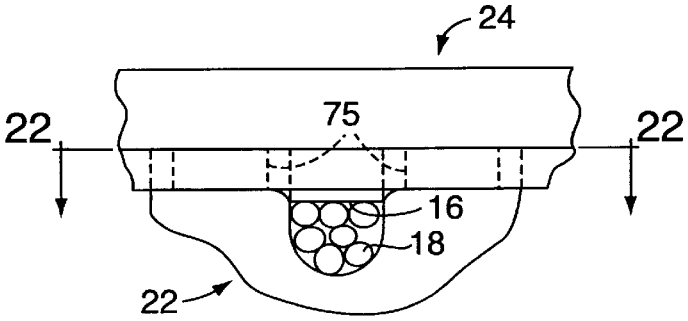
FIG. 21 is similar to FIG. 20 but shows the termination after final assembly.
Figure 22:
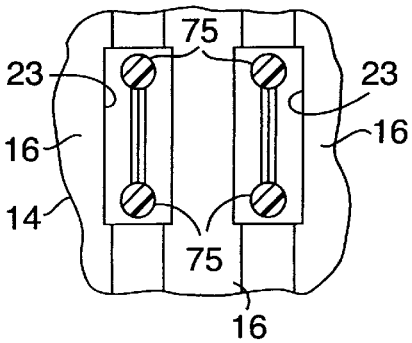
FIG. 22 is a fragmentary sectional view taken along the line 22—22 of FIG. 21.

The primary and secondary energy directors are strategically positioned to form welds or integral connecting portions of the cradle member and energy director cap which extend through the apertures 23, 23 the connection portions being indicated by the numerals 75, 75 and shown in FIGS. 21 and 22. Thus, a pair of connecting portions 75, 75 are formed which extend through each aperture 23 proximate the opposite ends of the aperture so that four points of connection are established between the cradle member 22 and the energy director cap 24 with respect to each terminated trace 16 (i.e. two connecting portions 75, 75 adjacent each side of each trace 16). Since the aforesaid connecting portions disposed within the slots 23, 23 are formed while the terminal assembly 10 is under compression and the various conductors 18, 18 are compression by the associated traces 16, 16 which bear upon the conductors the stored energy in each resilient conductor 18 continuously biases the conductor toward and into contacting engagement with its associated trace 16 after the assembly has been completed. Due to the strategic location of the points of contact between the primary and secondary energy directors which cooperate within the slots to define the integral connecting portions 75, 75, heat dissipation is controlled during the welding process so that the delicate traces 16, 16 are not exposed to excessive heat while the terminal assembly sections 22 and 24 are being welded together. Substantially the only heat sink at each termination is provided by the connector 18 which comprises the termination. The various other energy directors which form the welds to maintain the energy director cap and cradle member in assembled relation to each other are remotely located relative to the regions of termination, which regions are generally defined by traces between the rectangular apertures 23, 23. Thus, the two part terminal assembly 10 is effectively assembled without exposing the regions of electrical termination to excessive heat. The insulation on the stranded conductor free end portions located within the cavity 39 controls the wire strands at the free ends of the conductors 18, 18 to prevent electrical shorting between the strands at the free ends of adjacent conductors in the high density array. The bottom surface of the energy director cap 24 cooperates with the top surface of the cradle member to sandwich the membrane 14 in a flat condition therebetween and prevents molten plastic material from migrating between the coengaging surfaces of the terminal assembly 10 and the membrane 14 while the two sections of the terminal assembly are being welded together.

I claim:

1. A thin-film electrical termination comprising; a terminal assembly including a cradle member having a top surface and an energy director cap having a bottom surface disposed in opposing relation to said top surface, said cradle member having a conductor receiving slot opening upwardly through said top surface, an axially elongated electrical conductor received within said slot and having an axially extending upwardly exposed conducting portion, a circuit membrane having an associated portion thereof disposed between said cradle member and said energy director cap and having an electrically conductive trace thereon, said trace including a contact portion engaged with said conductor along said axially extending conducting portion within said slot, said membrane having apertures therethrough at opposite sides of said trace and in registry with portions of said top and bottom surfaces, and connecting means integrally connected to said cradle member and said energy director cap and extending through said apertures between said top surface and said bottom surface for maintaining said energy director cap in assembly with said cradle member with a portion of said membrane clamped between said cradle member and said energy director cap and said contact portion of said trace in resilient bearing engagement with said axially extending conducting portion of said electrical conductor within said slot whereby said electrical conductor is maintained in electrically terminating relation to said electrically conductive trace.

2. A thin-film electrical termination as set forth in claim 1 wherein said electrical conductor is further characterized as a resilient compressible conductor and said contact portion of said trace bears upon said axially extending conducting portion and maintains said electrical conductor in compressed condition within said slot.

3. A thin-film electrical termination as set forth in claim 2 wherein said portion of said circuit membrane is maintained in a substantially flat condition by said bottom surface and said electrical conductor.

4. A thin-film electrical termination as set forth in claim 2 wherein said slot has a width dimension substantially equal to the width dimension of said electrical conductor.

5. A thin-film electrical termination as set forth in claim 1 wherein said slot has a generally rectangular horizontal cross-section and each of said apertures is further defined as a generally rectangular aperture disposed in generally adjacent parallel alignment with said slot.

6. A thin-film electrical termination as set forth in claim 5 wherein said connecting means comprises a plurality of spaced apart connecting members extending through each of said apertures.

7. A thin-film electrical termination as set forth in claim 6 wherein said connecting members are spaced apart in directions generally parallel to the direction of axial extent.

8. A thin-film electrical termination as set forth in claim 7 wherein said connecting members are disposed proximate opposite ends of said rectangular apertures.

9. A thin-film electrical termination as set forth in claim 5 wherein said contact portion of said trace has a width dimension less than the width dimension of said slot.

10. A thin-film electrical termination as set forth in claim 9 wherein said contact portion of said trace substantially covers a space between said apertures.

11. A thin-film electrical termination as set forth in claim 1 wherein said circuit membrane comprises a part of a multi-layer keypad.

12. A thin-film electrical termination as set forth in claim 11 wherein said circuit membrane comprises a layer of said keypad and includes an integral termination tab which extends outwardly from said keypad and said associated portion of said circuit membrane is defined by said termination tab.

13. A thin-film electrical termination as set forth in claim 12 wherein said keypad includes a stiffener having an integral support tab projecting outwardly beyond said keypad in underlying relation to an associated portion of said termination tab and said support tab terminates in spaced relation to said apertures formed in said termination tab.

14. A thin-film electrical termination as set forth in claim 1 wherein said electrical conductor is further characterized as a stranded electrical conductor having an outer insulation jacket and said axially extending conducting portion is further characterized as an externally exposed electrically conducting portion spaced from an end portion of said insulated conductor.

15. A thin-film electrical termination as set forth in claim 14 wherein said end portion has an insulation jacket thereon and said cradle member defines a cavity containing said end portion.

16. A thin-film electrical termination as set forth in claim 1 wherein said trace comprises electrically conductive ink.

17. A thin-film electrical termination as set forth in claim 1 wherein said electrical conductor comprises a stranded electrical conductor.

18. A high density in-line array of thin-film electrical terminations comprising; a terminal assembly including a cradle member having a top surface and an energy director cap having a bottom surface disposed in opposing relation to said top surface, said cradle member having an in-line series of parallel conductor receiving slots opening upwardly through said top surface, a plurality of elongated electrical conductors each of said conductors having an axially extending electrically conductive portion received within and associated one of said slots and including an upwardly exposed electrically conductive portion, a circuit membrane having a portion thereof disposed between said cradle member and said energy director cap, said membrane having a plurality of electrically conductive traces thereon at least some of which are terminated traces, each of said terminated traces including a contact portion, said contact portion of each of said terminated traces being disposed in engagement with an upwardly exposed electrically conductive portion within an associated slot, said membrane having apertures therethrough at opposite sides of said slots and in registry with portions of said top surface and said bottom surface disposed between said slots, and connecting means integral to said cradle member and said energy director cap and extending through said apertures between said top surface and said bottom surface for maintaining said energy director cap in assembly with a portion of said cradle member with said membrane therebetween and said contact portions of said terminated traces in resilient bearing engagement with an associated axially extending exposed electrically conductive portions.

19. A high density in-line array of thin-film electrical terminations as set forth in claim 18 wherein the width of each of said slots is greater than the spacing between adjacent slots in said series.

20. A method for terminating a contact portion of an electrically conductive trace on a surface of a circuit membrane comprising the steps of forming a terminal assembly having separate thermoplastic sections including a cradle member and an energy director cap for assembly with the cradle member, the cradle member having a top surface, a conductor receiving slot opening through the top surface, and secondary energy directors projecting upwardly from and extending along said top surface at opposite sides of the slot, the energy director cap having a bottom surface and primary energy directors depending from said bottom surface for engaging said secondary energy directors when the cradle member and the energy director cap are brought together in assembly, positioning at least one axially elongated resilient compressible electrical conductor within the slot to form a conductor stack within the slot comprising the one conductor, the conductor stack having a height dimension greater than the depth dimension of the slot and including an axially extending conductive portion of one conductor exposed above the slot, forming apertures through the circuit membrane at opposite sides of the contact portion for registry with the first and second energy directors during assembly of the cradle member and the energy director cap, positioning the membrane on the cradle member with the secondary energy directors projecting upwardly into the apertures and the contact portion of the trace engaged with the axially extending exposed conductor portion of the one electrical conductor, positioning the energy director cap with the bottom surface thereof disposed in opposing relation to the top surface of the cradle member and the primary energy directors in registry with the apertures, applying compressive force to the thermoplastic sections urging the opposing top and bottom surfaces toward each other to urge the primary and secondary energy directors into engagement with each other within the apertures and the contact portion of the trace into compressing engagement with the axially extending exposed conductive portion of the one conductor, applying high frequency vibratory energy to the sections to melt the primary and secondary energy directors while simultaneously applying compressive force to the sections to maintain the trace in compressing engagement with the axially extending exposed conductive portion of the compressible electrical conductor, ceasing application of high frequency vibratory energy when the circuit membrane is clamped between the top and bottom surfaces and while applying compressive force to the sections allowing the melted thermoplastic material which defines the energy directors to solidify to weld the sections in assembly with each other with the contact portion of the trace bearing upon and in electrically contacting engagement with the axially extending exposed conducting portion of the one conductor, and releasing the applied compressive force after the melted material has solidified.

21. A method for terminating a contact portion of an electrically conductive trace on a surface of a circuit membrane as set forth in claim 20 wherein the step of applying high frequency vibratory energy is further characterized as applying ultrasonic vibratory energy.

22. A method for terminating a contact portion of an electrically conductive trace on a surface of a circuit membrane as set forth in claim 20 including the step of increasing the applied compressive force coincident with the step of applying high frequency vibratory energy.

23. A method for terminating a contact portion of an electrically conductive trace on a surface of a circuit membrane as set forth in claim 20 wherein the step of forming is further characterized as forming each of the energy directors with a generally triangular cross-section.

24. A method for terminating a contact portion of an electrically conductive trace on a surface of a circuit membrane as set forth in claim 23 wherein the step of forming is further characterized as forming the triangular cross-section of each of the energy directors with an apex having an included angle of about 60 degrees.

25. A method for terminating a contact portion of an electrically conductive trace on a surface of a circuit membrane as set forth in claim 20 including the additional step of determining the compressibility factor of the conductor and the step of forming is further characterized as forming the slot with a depth substantially equal to the height dimension of the stack less the compressibility factor of the conductor stack.

26. A method for terminating a contact portion of an electrically conductive trace on a surface of a circuit membrane as set forth in claim 25 wherein the step of determining the compressibility factor is further characterized as providing a test material defining a test slot having a slot width substantially equal to the nominal width dimension of the conductor and an inner end substantially complementing an associated portion of the conductor, positioning the conductor stack within the test slot, applying to the conductor stack within the test slot a test force substantially equal in magnitude to the maximum compressive force applied during assembly, and determining the change in dimension of the conductor stack in the direction of the applied test force.

27. A method for terminating a contact portion of an electrically conductive trace on a surface of a circuit membrane as set forth in claim 20 wherein the method includes the additional step of supporting the one of the sections in a fixture mounted on an ultrasonic welding machine, the step of applying compressive force is further characterized as applying compressive force with a horn of the ultrasonic welding machine, and the step of applying high frequency vibratory energy is further characterized as applying ultrasonic vibratory energy to the sections with the horn of the welding machine.

28. A method for terminating a contact portion of an electrically conductive trace on a surface of a circuit membrane as set forth in claim 20 including the additional step of increasing the magnitude of the applied compressive force coincident with the slip of applying high frequency vibratory energy.

29. A method for terminating contact portions of a high density in-line array of electrically conductive traces on a surface of a circuit membrane comprising the steps of forming a terminal assembly having separate thermoplastic sections including a cradle member and an energy director cap, the cradle member having a top surface, an in-line series of parallel conductor receiving slots opening through the top surface, barriers between adjacent slots and adjacent the end most slots in the series and defining portions of the top surface, and secondary energy directors projecting upwardly from the barriers, the energy director cap having a bottom surface and primary energy directors depending from the bottom surface for engaging the secondary energy directors when the bottom surface is disposed in opposing relation to the top surface, positioning axially extending exposed conducting portions of axially elongated resilient compressible electrical conductors within the slots in axial alignment with the slots to extend above the top surface, forming apertures through the circuit membrane at opposite sides of each of said contact portions for registry with the primary and secondary energy directors, positioning the membrane on the cradle member with the secondary energy directors projecting upwardly into the apertures and the contact portions of the traces to be terminated engaged with axially extending exposed conducting portions of the electrical conductors disposed within the slots, positioning the energy director cap with the bottom surface thereof disposed in opposing relation to the top surface of the cradle member and portions of the primary energy directors in registry with portions of the secondary energy directors, applying compressive force to the thermoplastic sections urging the top and bottom surfaces toward each other to bring the primary and secondary energy directors into engagement with each other within the apertures, applying high frequency vibratory energy to the sections while compressive force is applied to the sections to melt the thermoplastic energy directors and bring the traces to be terminated into compressing engagement with associated compressible electrical conductors within the slots, ceasing the application of high frequency vibratory energy to the sections while compressive force is being applied to the sections to allow the molten plastic material to solidify forming welds bonding the top surface to the bottom surface through the apertures, and ceasing application of compressive force after the molten material has solidified.

30. A method for terminating contact portions of a high-density in-line array of electrically conductive traces on a surface of a circuit membrane as set forth in claim 29 wherein the step of forming is further characterized as forming an in-line series of conductor receiving slots having slot widths wider than the widths of the barriers between the slots.

31. A method for terminating contact portions of a high-density in-line array of electrically conductive traces on a surface of a circuit membrane as set forth in claim 30 wherein the step forming a terminal assembly is further characterized as forming the energy directors with triangular cross-sections.

32. A method for terminating contact portions of a high-density in-line array of electrically conductive traces on a surface of a circuit membrane as set forth in claim 29 wherein the step of forming the energy directors is further characterized as forming the secondary energy directors to extend in parallel relation to each other and in the direction of axial extent.

33. A method for terminating contact portions of a high-density in-line array of electrically conductive traces on a surface of a circuit membrane as set forth in claim 32 wherein the step of forming the energy directors is further characterized as forming the primary energy directors in spaced apart relation to each other in the direction of axial extent.

* * * * *